United States Patent [19]

Hietikko et al.

[11] Patent Number: 4,923,568

[45] Date of Patent: May 8, 1990

[54] DEWATERING ZONE IN A PAPERMACHINE

[75] Inventors: Erkki Hietikko; Ilpo Kylmäkorpi, both of Tampere, Finland

[73] Assignee: Oy Tampella Ab, Tampere, Finland

[21] Appl. No.: 215,849

[22] Filed: Jul. 6, 1988

[30] Foreign Application Priority Data

Jul. 9, 1987 [FI] Finland ..... 873034

[51] Int. Cl.[5] ..... D21F 1/00

[52] U.S. Cl. ..... 162/301; 162/308; 162/352; 162/363; 162/364; 162/368; 162/370

[58] Field of Search ..... 162/301, 352, 308, 364, 162/368, 370, 363, DIG. 11, 203

[56] References Cited

U.S. PATENT DOCUMENTS

| | | | |
|---|---|---|---|
| 2,369,653 | 2/1945 | Berry et al. | 162/364 X |
| 3,149,027 | 9/1964 | Mih | 162/364 X |
| 3,824,152 | 7/1974 | Nevalainen | 162/301 |
| 4,125,428 | 11/1978 | Phelps | 162/364 X |
| 4,176,005 | 11/1979 | Bubik et al. | 162/256 |
| 4,207,144 | 6/1980 | Meinecke et al. | 162/352 X |
| 4,517,054 | 5/1985 | Hujàla et al. | 162/301 |
| 4,614,566 | 9/1986 | Koponen et al. | 162/301 |

FOREIGN PATENT DOCUMENTS

| | | |
|---|---|---|
| 3117463 | 4/1981 | Fed. Rep. of Germany . |
| 3107730 | 8/1984 | Fed. Rep. of Germany . |
| 51228 | 9/1973 | Finland . |
| 813276 | 10/1981 | Finland . |
| 823776 | 1/1984 | Finland . |
| 830519 | 8/1984 | Finland . |
| 843395 | 8/1985 | Finland . |

OTHER PUBLICATIONS

"Was erwartet der Papiermacher von der Blattbildung und Welche Systeme Stehen ihm zur Verfugung", Wochenblatt for Papierfabrikation 11/12 1981, pp. 361–370.

*Primary Examiner*—Peter Chin
*Assistant Examiner*—Thi Dang
*Attorney, Agent, or Firm*—Pollock, Vande Sande & Priddy

[57] ABSTRACT

A joint dewatering zone of wires for dewatering a web to be formed in a two-wire papermachine having a first wire loop and a second wire loop, includes a first forming roll which is situated inside the second wire loop and other dewatering means which are situated after the first forming roll inside the first wire loop. The other dewatering means comprises as a combination a first suction box, a second suction box with a curved guiding surface, and a roll interposed between the suction boxes.

11 Claims, 4 Drawing Sheets

DEWATERING ZONE IN A PAPERMACHINE

BACKGROUND OF THE INVENTION

The present invention relates to a joint dewatering zone of wires for dewatering a web to be formed in a two-wire papermachine having a first wire loop and a second wire loop, in which zone a first forming roll is situated inside the second wire loop and in which zone other dewatering means are situated after the first forming roll inside the first wire loop.

The present invention is applicable also to board machines, and the term "papermachine" signifies both papermachines and board machines in this context.

The invention is especially intended for two-wire machines wherein between a headbox and a two-wire former there is a single-wire initial section where the web obtains a suitable felting degree whereafter dewatering of the web takes place within the two-wire section, which starts at a point where the second wire loop, guided by the first forming roll, joins the first wire loop forming the said single-wire initial section.

The purpose of the two-wire formers described above is to obtain a better formation and to eliminate unequal-sidedness in paper by draining water out of the opposite sides of the web through both wires. This affects uniform distribution of additives in the web, such as fillers, and of fines in the web. Further, an improved dewatering capacity is achieved by means of two-wire formers.

The examples of the constructions mentioned above, are shown, for example Finnish Patent Applications Nos. 820742 and 820743 (Valmet Oy), Finnish Patent Application No. 813276 and U.S. Pat. No. 4.176.005 (Escher Wyss GmbH) as well as German Pat. No. 3.107.730 (J. M. Voith GmbH).

The above-mentioned two-wire formers have the drawback that the control of dewatering is poor and abrupt changes in dewatering rate can not be controlled, which results e.g. in undesirable removal of fillers added to the stock and of fine fibres too, as well as in a deteriation of web quality.

SUMMARY OF THE INVENTION

It is an object of the present invention to provide a joint dewatering zone of wires in a two-wire papermachine eliminating the abrupt changes in dewatering rate and improving the controllability of dewatering operation. For achieving this purpose, the dewatering zone in question is mainly characterised in that the dewatering means inside the first wire loop, being situated after the first forming roll inside the second wire loop, comprise as a combination the following means adapted to be co-operative:

a first suction box a second suction box a roll interposed between the said suction boxes The above-mentioned arrangement, wherein the first suction box can be constituted of a single box or several boxes in sequence as a group of suction boxes, makes it possible to provide a long active dewatering zone, wherein the drainage of water can be adjusted in a controllable manner using mainly suction box pressures which can be adjusted independently of each other. Friction in the adjustable dewatering zone can be decreased considerably by means of the roll disposed between the suction boxes, on which roll the joint run of the wires is curved within a sector of suitable magnitude. It is also possible to form a chamber between the suction boxes and the roll, this being useful in the adjustment of dewatering and friction.

The surface of the first suction box in contact with the first wire is preferably straight, in which case the straight run of the wires leaving the first forming roll joins it in a parallel position. In this way, a tranquillisation zone is formed in the two-wire section after the first forming roll, and the drainage rate is not very high in this section. This helps partly to eliminate the drawbacks caused by too abrupt changes in drainage rate.

Due to the construction constituted of the two suction boxes and the roll disposed therebetween, it is possible to achieve a more efficient drainage as well as a good adjustability of drainage using the arrangement of the dewatering means of the dewatering zone in accordance with the invention. By means of the suction boxes, the roll and the structure of one or several chambers between the suction boxes and the roll, it is possible to adjust dewatering pressure freely and independently to a desirable level at different locations along the travel of the web. At the same time a good retention of both the fibres and the fines as well as the adjustability of the retention is possible.

The invention also eliminates, to a considerable extent, the negative effects of friction. A great friction between the wires and the dewatering structures results in an unfavourable coefficient of utilization and in wear and in possible damage to various structures due to the heat of friction. With the aid of a roll between the suction boxes, the friction can be minimized. The friction can also be minimised by adjusting the pressure level in the chambers situated between the rolls and the suction boxes.

The combination formed by the suction boxes and the roll therebetween constitutes a constructionally practical entity, which easily can be realized in course of assembly.

In the following, the invention is described in more detail with references to the accompanying drawings, which show some preferable embodiments of the invention.

DETAILED DESCRIPTION OF THE PREFERRED EMBODIMENT

In the following, different parts of a papermachine along the travel of the web are described with references mainly to FIGS. 1 and 2 and with an emphasis mainly on the joint dewatering zone of wires in accordance with the invention.

Figure 1:
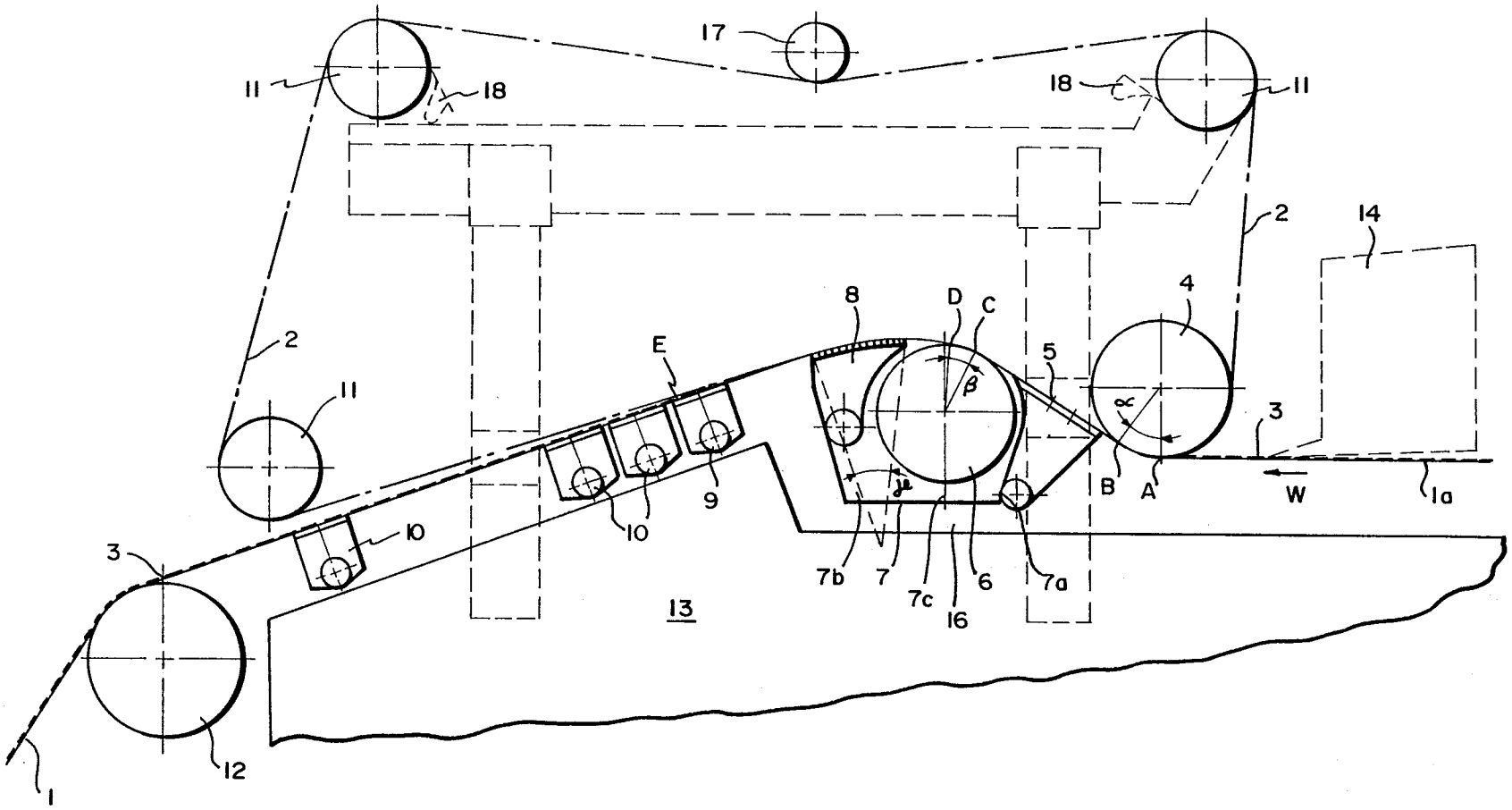
FIGS. 1 to 4 are schematical side elevation views of join dewatering zones of wires in accordance with the invention in a two-wire papermachine.

Both an upper wire 2 and a lower wire 1 form endless loops, whose sections in contact with each other at the two-wire part are illustrated in all FIGS. 1 to 4. Guide rolls and tensioning rolls with their doctor blades, situated at the upper part of the upper wire loop 2 and well-known in the art, are illustrated in FIG. 1. Corresponding rolls at the lower part of the lower wire loop 1 are not illustrated. The papermachine shown by FIGS. 1 and 2 comprises in the direction of travel of the web (arrow W) a single-wire section 1*a* situated directly after the headbox. Within this section the lower wire 1 and the web 3, which is indicated by a broken line, travel in a horizontal plane. This section is known as such in the connection of well-known papermachines comprising a two-wire former and it is therefore not described in more detail. Next in the direction of travel of the web there is situated the initial point of the two-wire section, denoted by letter A in the figures. At this point a first forming roll 4 guides the upper wire 2 onto the lower wire 1 and the web 3. The point A is situated at the lowest point of the periphery of the forming roll 4, seen with regard to the horizontal plane, and the tangent of the periphery coincides with the horizontal direction of travel of the single-wire section 1*a* at this point.

After the point A, the wires 1 and 2 and the web 3 between the wires are curved guided by the forming roll 4 in the direction of the periphery of the roll 4 within a sector $\alpha$, the curvature being in the case of FIG. 1 such that the angle of travel of the wires to the horizontal plane increases. At a point B, where the wires leave the roll 4 after the curvature within the sector $\alpha$, a straight portion starts, which ends at a point C, where the run of the wires arrives at the periphery of a second forming roll 6. Along this portion from B to C, a suction box 5 is situated on the side of the lower wire 2 and the straight surface of this box is in contact with the lower surface of the lower wire 1 and is parallel to the run of the wires 1, 2.

Figure 2:
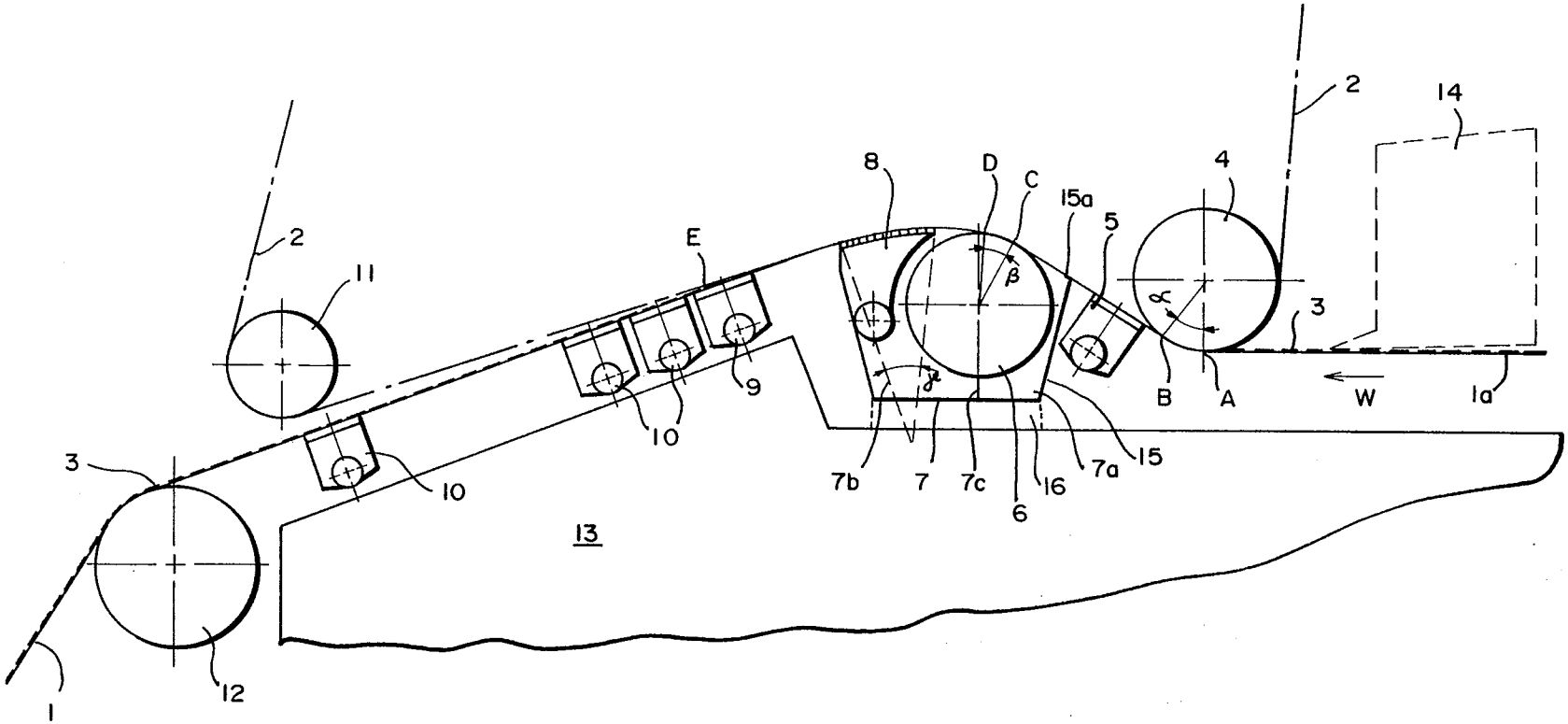
Figure 3:
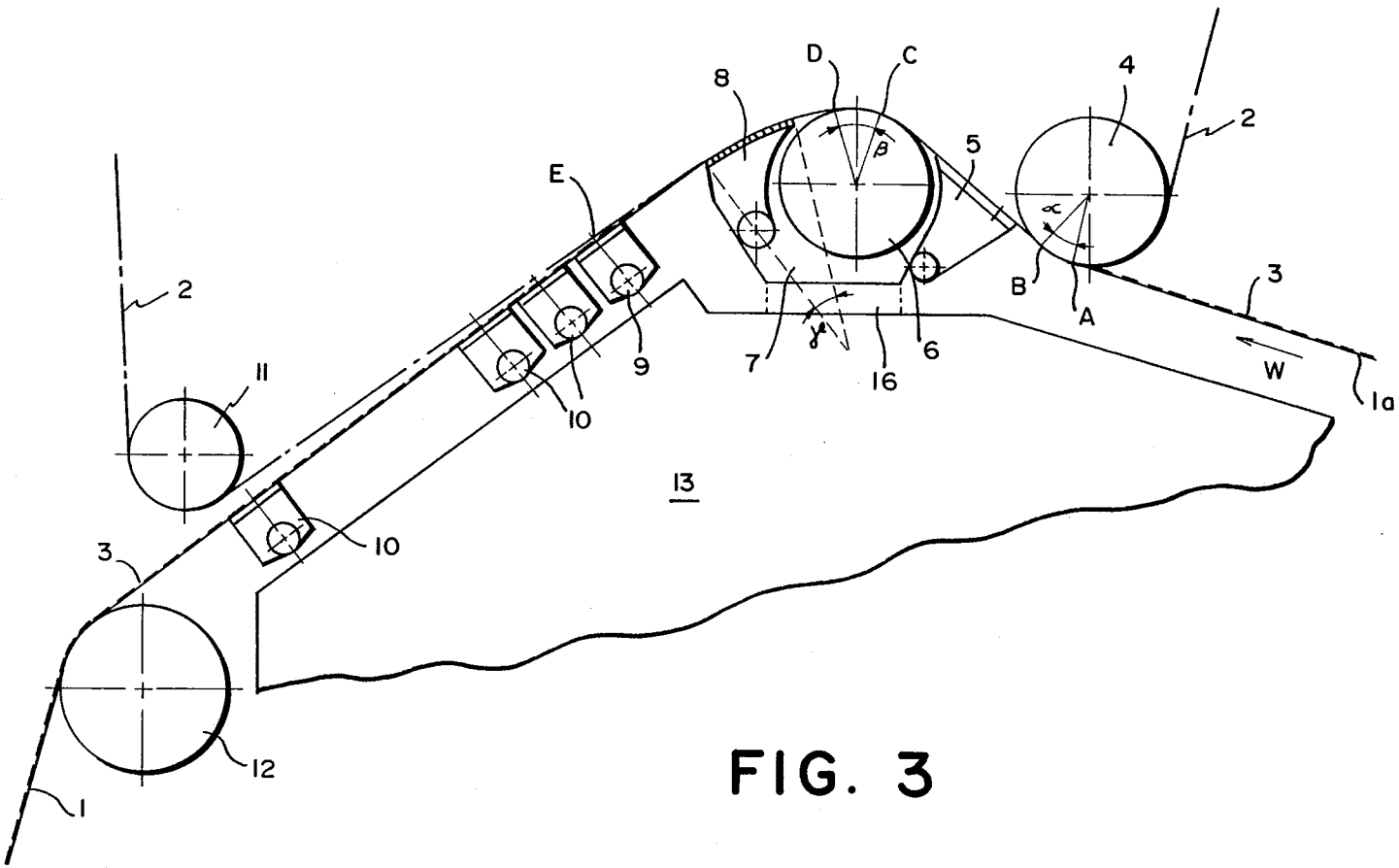
Figure 4:
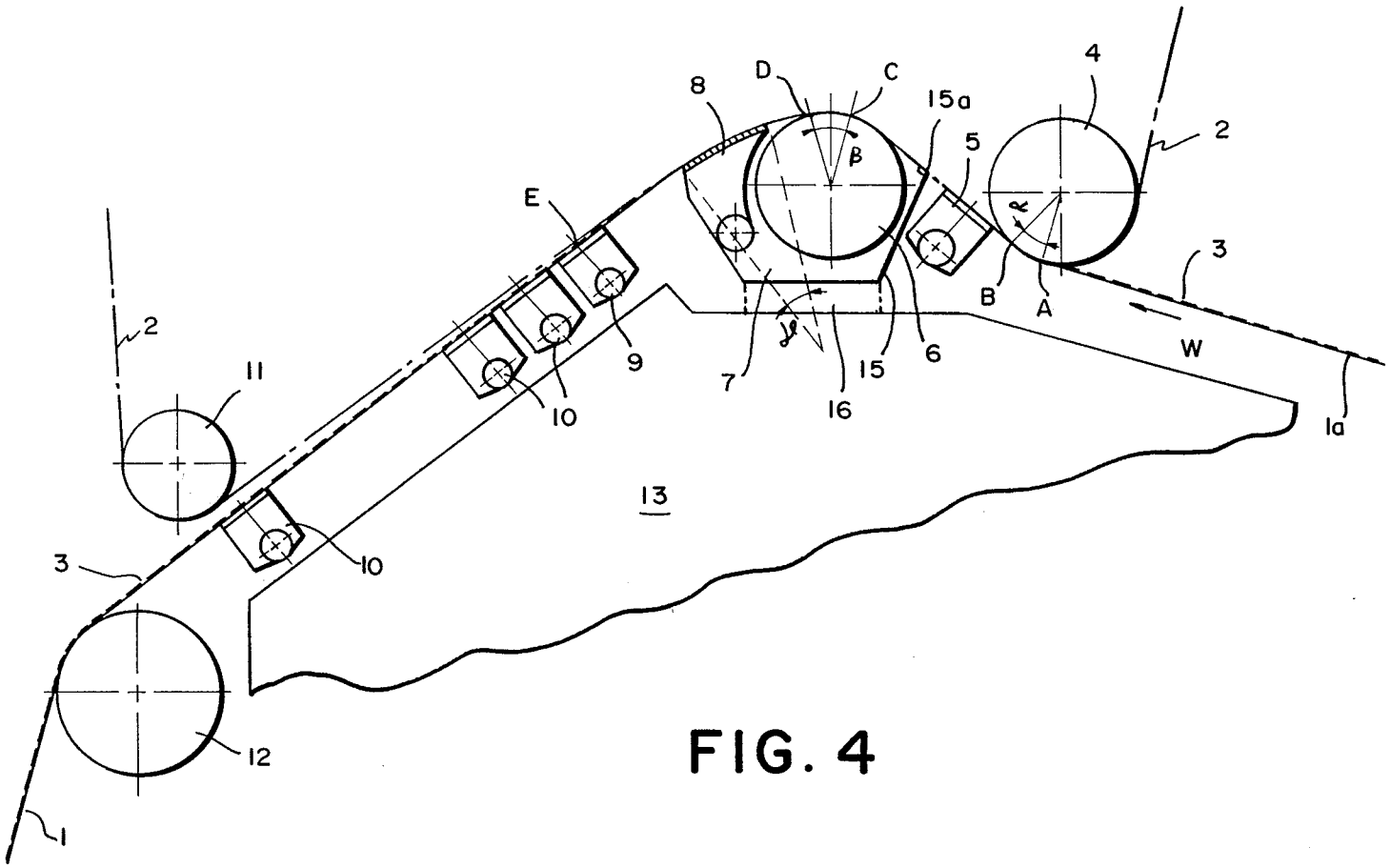

The curvature on the forming roll 4 within the sector $\alpha$ can take place also at another location on the roll with regard to the horizontal plane than at the location shown by FIGS. 1 and 2. The wire 1 can arrive at the first forming roll 4 in a position slanting upwards in the direction of travel of the web at an angle to the horizontal plane. In this case the initial point A of the two-wire portion is situated after the lowest point of the periphery of the roll 4, as seen in the direction of rotation of the roll. This alternative is illustrated by FIGS. 3 and 4. The wire 1 can arrive at the roll 4 also in a position slanting downwards and the joint run of the wires 1, 2 can in this case be sloping downwards, horizontal or sloping upwards after the curvature within the sector $\alpha$ on the periphery of the roll 4.

Further, in FIGS. 1 and 2 at a point C the straight run of the wires 1,2 directed slantingly upwards arrives at the periphery of a second forming roll 6 located on the side of the lower wire 1. The roll 6 rotates to a direction opposite to the roll 4, and the run of the wires is curved towards the horizontal plane in a magnitude of a sector $\beta$ to a direction opposite to the curvature taking place on the roll 4. The wires 1,2 leave the periphery of the forming roll 6 at a point D situated in the direction of travel of the web before the upper most point of the roll 6 (the point at which the tangent of the periphery lies in a horizontal plane). From the point D onwards the run of the wires goes on in the direction of the tangent of the point D slanting upwards at a small angle to the horizontal plane and it reaches next a suction box 8 on the side of the lower wire 1. The suction box 8 has a curved surface in contact with the lower face of the lower wire 1. The run of the wires 1, 2 is curved by the effect of this box within a section $\gamma$, this curvature being continued to the same direction as within the sector $\beta$ on the roll 6. At the location of the suction box 8 is also situated the highest point of the run of the wires 1, 2, at which point the tangent of the run is parallel to a horizontal plane, and after the rear or trailing edge of the suction box 8, the run of the wires is directed slantingly downwards, as seen in the direction of travel of the web.

In FIGS. 3 and 4 the highest point of the joint run of the wires 1, 2 is situated within the area of the sector $\beta$ of the roll 6 and lies thus at the highest point of the periphery of the roll 6. In this case the run of the wires 1, 2 is directed from the roll 6 after the point D slantingly downwards onto the suction box 8, on which the curvature is continued to the same direction within the sector $\gamma$.

The joint run of the wires 1, 2 terminates at a point E, where the upper wire, 1 is separated from the lower wire 2 and its run goes on through a guide roll 11 towards the upper portion of the upper wire loop, where guide rolls 11, a tensioning roll 17 and doctor blades 18 are situated (FIG. 1). At the point E on the side of the lower wire 2 there is provided a transfer suction box 9 and subsequently in the direction of travel of the web 3 there are provided flat suction boxes 10. The web 3 is run on the lower wire 1 through a suction roll 12 forwards and it is transferred from the lower wire 1 to a press section by arrangements, which are known previously and are therefore not described in this connection more precisely. The lower wire 1 continues its running to guide tensioning rolls in the lower portion of the lower wire loop. These rolls, which are well known in the art, are not illustrated.

In the following, the dewatering process within the two-wire dewatering zone from A to E is explained in more detail. Within the single-wire initial section la drainage has taken place through the lower wire and the web has reached a sufficient degree of felting when arriving at the point A. The first forming roll 4 is a hollow-faced roll, and the drainage starts to occur also upwards through the upper wire 2 within the sector $\alpha$ of its periphery, this being due to the open surface of the periphery and the pressure exerted by the wires 1, 2. Simultaneously the dewatering continues to take place downwards through the lower wire 1. After the first forming roll 4 within the section from B to C, the tranquillisation of the web 3 takes place after the dewatering at the location of the roll 4. This tranquillization is achieved by forming the portion from B to C to a straight portion, that is by forming the surface of the first suction box 5 in contact with the lower wire straight and parallel to the mutual tangent B to C of the peripheries of the rolls 4 and 6, along which tangent the join run of the wires 1, 2 travels. At the straight tranquillisation zone of the web from B to C dewatering can be adjusted in a controllable manner by means of pressure within the suction box 5 and this has a favourable effect on retention of fibres and fines.

As the run of the wires 1,2 reaches the point C, a new stage starts during which dewatering takes place through both the lower wire 2 and the upper wire 1 due to tensioning of the wires, suction and centrifugal force. The tensioning of the wires 1, 2 and the centrifugal force is increased gently by means of the sectors $\beta$ and $\gamma$. By means of the pressure within the second suction box 8, dewatering through the lower wire can also be adjusted in a controllable manner and this pressure can be adjusted independently of the pressure within the first suction box 5. The second forming roll 6 can be a smooth-faced solid-mantle roll, a hollow-faced roll or a suction roll as well.

By means of the combination formed by the first suction box 5, the roll 6 and the second suction box 8, successive after each other on the side of the lower wire 1, a substantially closed chamber 7 beneath the lower wire 1 can be provided around the roll 6. The chamber opens onto the lower face of the lower wire 1 on both sides of the sector $\beta$ of the roll 6. Pressure can be arranged in the chamber 7 and dewatering between also the trailing edge of the first suction box 5 and the front edge C of the sector $\beta$ as well as between the rear edge D of the sector and the front edge of the second suction box 8 can be adjusted by means of this pressure. Using the pressure within the chamber 7, friction occurring between the lower wire 2 and the combination of the suction boxes 5, 8 and the roll 6 therebetween can be adjusted.

As shown in FIGS. 1 and 3, the chamber 7 is constructed so that the suction boxes 5 and 8 and the roll 6 therebetween is placed in a support structure, which can be mounted into the rest of a frame 13 of the papermachine as one assembly unit. The support structure is mounted into the frame by means of an assembly beam 16 indicated by broken lines. The support structure and the above-mentioned parts placed therein constitute in this way the chamber 7, which surrounds as a substantially closed housing-like structure the periphery and the heads of the roll 6. On both sides of the sector of the roll 6, the chamber 7 opens onto the lower face of the lower wire 1, thus forming on one side the region between the trailing edge of the suction box 5 and the point C on the roll 6 and on the other side the region between the point D on the roll 6 and the leading edge of the suction box 8. The chamber is bounded on both sides of the sector $\beta$ of the roll 6 by the walls of the suction boxes 5 and 8 facing the periphery of the roll 6 and being curved at these locations in the same direction as the periphery of the roll 6.

FIGS. 2 and 4 show an arrangement where the first suction box 5 is a separate suction box and the roll 6 and the second suction box, forming together the portion being curved towards the same direction at the angles $\beta$ and $\gamma$, are placed in a support structure which can be mounted as one assembly unit into the rest of the frame 13 by means of the assembly beam 16. Also in this unit there is provided a chamber around the roll 6. The structure of this chamber differs from that of FIGS. 1 and 3 in the respect that the chamber wall preceding the roll 6 in the direction of travel of the web is formed by a separate wall 15, which is situated between the first, separate suction box 5 and the periphery of the roll 6. The edge of the wall facing the lower wire 1 is equipped with a guide list 15*a* in contact with the lower wire 1.

FIGS. 1 and 2 illustrate how the chamber 7 can be divided in two parts 7*a* and 7*b* by means of a partition wall 7*c*, which extends to the periphery of the roll 6 on the side opposite to the sector $\beta$. The former of the above-mentioned parts opens into between the first suction box 5 and the roll 6 and the latter opens into between the roll 6 and the second suction box 8. The adjustment of pressure is arranged in this case in each part to be independent of the pressure within the other part. A similar solution is possible also in the structures shown by FIGS. 3 and 4.

The construction of various parts of the two-wire section from A to E has many alternatives. The first forming roll 4 inside the upper wire loop 2 is a hollow-faced roll, such as a grooved roll, a blind-drilled roll, a through-drilled roll or any other corresponding roll, such as a suction roll. The roll can be covered with a wire sock and the open area of its hollow face is preferably at least about 50% of the entire mantle area of the roll. The roll 6 between the suction boxes 5 and 8 inside the lower wire loop 1 can have a similar construction as the above-mentioned roll 4. Further, the roll 6 can be a smooth-faced solid-mantle roll. The deck construction of the suction boxes 5 and 8 can be any kind of deck construction in common use.

The magnitude of sector $\alpha$ of curvature on the first forming roll 4 is 40° at the most. It is also possible, that the sector $\alpha$ is 0°, in which case the lower wire 2 is not curved at the roll 4 and the joint initial portion from B to C of the wires 1, 2 can be continued in the horizontal plane in the same direction as runs the single-wire portion 1*a* and the joint run of the wires 1, 2 is at no stage directed slantingly upwards with regard to the horizontal plane as seen in the direction of travel. The sector $\beta$ of curvature on the roll 6 is preferably 10° to 35° and the sector $\gamma$ of curvature on the suction box 8 is preferably 10° to 30°.

The dewatering structure constituted of the suction boxes 5 and 8, the roll 6 therebetween and the chamber 7 can be arranged to a compact housing-like structure, which easily can be mounted on the frame 13, this feature being useful in course of manufacture and assembly. The first suction box 5 can be also separate from the structure in accordance with FIGS. 2 and 4, but also in this case it can be well mounted onto the structure formed by the roll 6 and the second suction box 8 at assembly stage.

The structure of the invention is by no means restricted only to that represented by the figures. Thus, the angular position of various parts with regard to the horizontal plane can be varied and the location of the parts with regard to the wires 1, 2 can be also different, for example the first forming roll 4 can be situated inside the lower wire loop 1, the suction boxes 5, 8 and the roll 6 therebetween being situated inside the upper wire loop 2. The combination in accordance with the invention can be used also in board machines, for example for liner manufacture. This possibility is illustrated by FIGS. 1 and 2 wherein a secondary headbox 14 on the single-wire portion 1*a* is indicated by broken lines, this secondary headbox being intended for supply of stock onto the stock layer on the lower wire 1.

We claim:

1. A two-wire papermaking machine having a joint dewatering zone formed by a joint wire run of a first wire loop and a second wire loop, the first wire loop forming a single-wire initial portion preceding said dewatering zone, said dewatering zone comprising:

a first forming roll situated outside the second wire loop where the join wire run begins; and dewatering members situated, in the direction of travel of the wires, after said first forming roll and inside the first wire loop and in contact with the first wire, said dewatering members in said first loop including at least:

a first suction box having means for providing a predetermined pressure; a second suction box located after said first suction box in the direction of travel of the wires and having means for providing a predetermined pressure;

a second forming roll interposed between said suction boxes;

means for defining a substantially closed chamber inside the first wire loop around the second forming roll and at least one of the suction boxes, said chamber opening onto the face of the first wire loop being in contact with the second forming roll; and means for adjusting the pressure in said chamber independently of the pressures within said suction boxes.

2. Dewatering zone as claimed in claim 1, wherein at least one of said suction boxes and said second forming roll disposed between said suction boxes together with said substantially closed chamber are arranged in a support structure, which is mounted into the rest of a frame of the papermaking machine as one assembly unit.

3. Dewatering zone as claimed in claim 2, wherein said first suction box, said second suction box and said second forming roll disposed therebetween are arranged in a support structure, which is mounted into the rest of a frame as one assembly unit.

4. Dewatering zone as claimed in claim 1, wherein said means for providing a predetermined pressure of said first and second suction boxes are adjustable independently of each other.

5. Dewatering zone as claimed in claim 1, wherein said chamber is divided into two parts, one part opening between said first suction box and said second forming roll onto the face of said first wire in contact with said second forming roll, and the other part opening between said second forming roll and said second suction box onto said face of said first wire, both parts of said chamber having means for adjusting pressure independently of each other.

6. Dewatering zone as claimed in claim 1, wherein said second suction box has a curved guiding surface for guiding the two wires along a curved path within a predetermined section.

7. Dewatering zone as claimed in claim 6, wherein the radius of curvature of said curved path at said second suction box is larger than the radius of said second forming roll interposed between said suction boxes.

8. Dewatering zone as claimed in claim 1, wherein a tranquillization zone of a web is created by providing a straight surface on said first suction box being in contact with said first wire.

9. Dewatering zone as claimed in claim 8, wherein the surface of said first suction box being in contact with said first wire extends in the direction of a tangent of said second forming roll.

10. Dewatering zone as claimed in claim 1, wherein the surface of said first suction box being in contact with said first wire extends in the direction of a tangent of said first forming roll situated inside said second wire loop.

11. Dewatering zone as claimed in claim 8, wherein the surface of said first suction box in contact with said first wire extends in the direction of common tangent of the peripheries of said first forming roll situated inside said second wire loop and said second forming roll disposed between said suction boxes.

* * * * *